United States Patent [19]

Holt

[11] 4,009,309

[45] Feb. 22, 1977

[54] METHOD OF MAKING STAINED GLASS EFFECT ARTICLES

[76] Inventor: John Frederick Dent Holt, 2 Ariel Court, Ashchurch Park Villas, London W.12, England

[22] Filed: Dec. 10, 1974

[21] Appl. No.: 531,295

Related U.S. Application Data

[62] Division of Ser. No. 369,858, June 14, 1973, Pat. No. 3,876,483.

[30] Foreign Application Priority Data

Sept. 26, 1972 United Kingdom ..... 44473/72

[52] U.S. Cl. ..... 428/38; 428/67; 428/164; 428/173; 428/209; 428/210; 240/108 R; D48/16 D

[51] Int. Cl.[2] ..... B44C 5/08; B44F 1/06

[58] Field of Search ..... 428/38, 35, 67, 164, 428/173, 212, 195, 203, 209, 210; 240/108 R, 108 A, 108 B; D48/16 A, 16 D, 16 E

[56] References Cited

UNITED STATES PATENTS

| | | | |
|---|---|---|---|
| 1,911,357 | 5/1933 | Finley | 428/203 |
| 2,811,800 | 11/1957 | Gesek | 428/38 |
| 3,064,380 | 11/1962 | Baut et al. | 428/38 |
| 3,247,046 | 4/1966 | Fazekas | 428/38 |
| 3,382,134 | 5/1968 | Powell | 428/38 |
| 3,399,101 | 8/1968 | Magid | 428/203 |
| 3,420,728 | 1/1969 | Haverstock | 428/38 |
| 3,546,051 | 12/1970 | Utz | 428/38 |
| 3,563,821 | 2/1971 | Turtaud | 428/38 |
| 3,655,493 | 4/1972 | Campbell | 428/38 |
| 3,815,263 | 6/1974 | Oberwager | 428/38 |
| D215,172 | 9/1969 | Seger | D48/16 E |
| D226,216 | 1/1973 | Rice | D48/16 E |

*Primary Examiner*—Marion E. McCamish
*Assistant Examiner*—William R. Dixon, Jr.
*Attorney, Agent, or Firm*—Fleit & Jacobson

[57] ABSTRACT

A method of making simulated stained glass articles, and articles, such as Tiffany lamp shades made thereby, comprising forming a first pre-form of translucent material with first and second smooth surfaces, applying a pre-patterned colored film over the first surface of the first pre-form, forming a second pre-form of translucent material with a smooth first surface and preformed in the second surface channels adapted to register with the boundaries of the different colors of the film, placing the second pre-form over the first pre-form so that the first surface of the second pre-form is in contact with the film, applying a leading effect in the channels and sealing the free edges of the two pre-forms to one another.

3 Claims, 2 Drawing Figures

METHOD OF MAKING STAINED GLASS EFFECT ARTICLES

Figure 1:
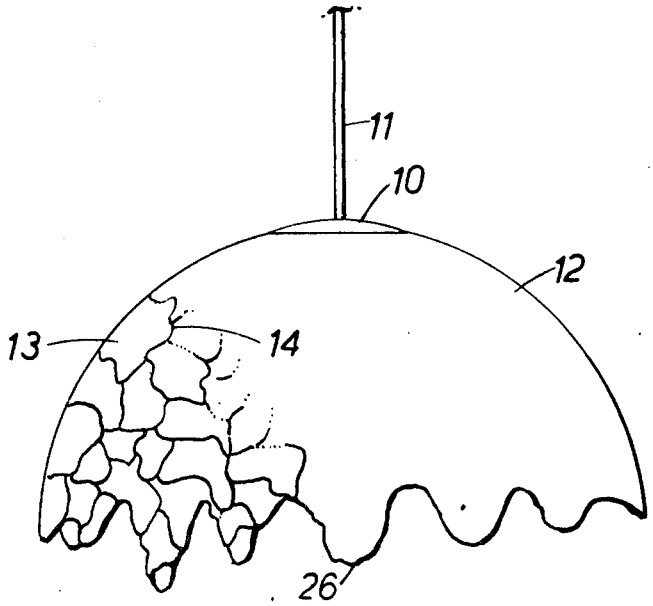

This is a division of application Ser. No. 369,858, filed June 14, 1973, now U.S. Pat. No. 3,876,483.

The present invention relates to a method of making simulated stained glass articles.

Many attempts have been made in the past to manufacture stained glass articles but the actual production of true stained glass articles is extremely expensive. Thus, attempts have been made to make simulated stained glass articles from plastics material but none of these has been truly successful. One particularly popular form of stained glass article is so-called "Tiffany glass". Such Tiffany glass takes many forms but one particularly attractive form is that of a lamp shade. The Tiffany glass lamp shades are generally bowl-shaped and include a fine mosaic of stained glass patterned portions separated from one another by leaded portions. These lamp shades are particularly beautiful and the original forms produced by Tiffany exhibited especially attractive color effects. It is an object of the present invention to provide a method of making simulated stained glass articles, such as simulated Tiffany glass lamp shades, which is relatively inexpensive and yet produces a satisfactory product.

According to the present invention, there is provided a method of making simulated stained glass articles, such method comprising forming a first pre-form of translucent material with first and second smooth surfaces, applying a pre-patterned colored film over the first surface of the first pre-form, forming a second pre-form of translucent material with a smooth first surface and preformed in the second surface channels adapted to register with the boundaries of the different colors of the film, placing the second pre-form over the first pre-form so that the first surface of the second pre-form is in contact with the film, applying a leading effect in the channels and sealing the free edges of the two pre-forms to one another.

The method of the present invention may be applied to making planar stained glass effect elements such as stained glass windows and in this instance the first and second pre-forms may be formed of glass.

The invention is also suitable for manufacture of articles such as the abovementioned Tiffany glass lamp shades in which case it is preferable that the first and second pre-forms are injection moulded or vacuum formed from a translucent plastics material. Particularly suitable materials are cellulose acetate material for the first pre-form which would be the inner pre-form of a bowl-shaped lamp shade, and polycarbonate material for the outer or second pre-form. Such a material produces a particularly pleasing high quality glass effect and gives strength.

Preferably, the leading effect is produced by introducing the first and second pre-forms, with the film material sandwiched in between, into a mold and injecting a leading effect plastics material into the channels.

Figure 2:
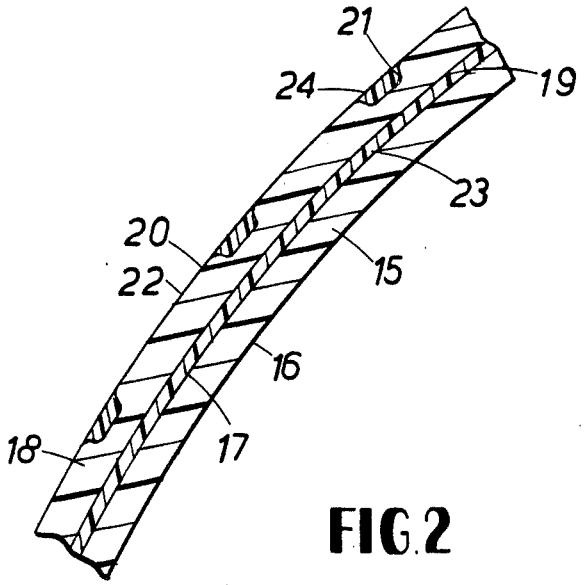

In order that the invention may more readily be understood, the following description is given, merely by way of example, reference being made to the accompanying drawings, in which:

FIG. 1 is a side elevation illustrating diagrammatically one form of a Tiffany lamp which may be produced by the method according to the invention; and FIG. 2 is an enlarged cross-section of a portion of the lamp of FIG. 1.

The lamp shade illustrated in FIG. 1 includes a bulb holding attachement 10 provided with a supporting flex or other support 11, for example an internal support for a stem of a standard lamp. A bowl-shaped translucent element 12 is supported by the lamp holder 10 and is provided with a multiplicity of colored panels 13 separated from one another by lead effect material 14. In the true Tiffany lamp glass panels of finely produced color are separated by lead.

The method of constructing the simulated lamp can be appreciated more clearly from FIG. 2. In the first step of the forming operation, a pre-form or "moll" 15 is produced by injection molding from a translucent plastics material such as cellulose acetate. The inner surface 16 and the outer surface 17 are constructed so as to be substantially smooth. If desired, instead of injection molding, the moll 15 can be produced by vacuum forming. A second pre-form or moll 18 is produced by injection molding and has an inner surface 19 which is smooth and an outer surface 20 which is uneven or roughened. This pre-form is formed again of a translucent plastics material and a particularly desirable material is polycarbonate. The outer surface of the moll 18 is pre-formed, during its moulding operation, with channels 21 leaving lensed areas or slab glass type surfaces 22 therebetween.

A layer 23 of film material is pre-patterned with the desired colored pattern of the finished article. This colored pattern may be produced either photographically, or by adding or piecing together cut-out portions of colored film materials, of cellulose acetate, for example. However, a preferred method is to litho or silk screen color print the pattern, e.g. on polyester (or polyurethane) film or cellulose acetate film. The layer 23 is cut-out to a shape which enables it to conform to the generally part-spherical shape of the outer surface 17 of the inner moll or pre-form 15. If it is desired to produce a particular lustre or color effect, it may be necessary to provide a number of layers of the film material 19.

In the course of manufacture, the moll 15, having been pre-formed, has the layout or layer 23 of color film applied thereto and subsequently the outer moll or pre-form 18 is put in place as shown. In a preferred method of the further construction, the whole assembly is then placed in a mold and leading effect plastics material is injected by a conventional injection molding technique into the channels 21 to give the leading effect 24. The leading effect may be flush with, below or extend above of the outer surface of the lensed areas 22. This last effect could be achieved by providing corresponding channels in the mold. The mold is so shaped that the lower edge 26 (FIG. 1) and the upper edge into which the fitting 10 (or 11 for stand) is engaged, are themselves provided with the leading effect, thus effectively sealing the two molls together with the film material sandwiched therebetween.

It is also contemplated, according to the invention, that instead of injecting the leading effect, this can be produced by providing a soft metal wire or plastics material lattice which is subsequently held in place in the channel 21. For this purpose, the channels 21 may be provided with convergent side walls to provide a dovetail effect to hold the lattice in place.

While the invention has been particularly described with reference to a Tiffany lamp, it could equally be applied to other decorative simulated stained glass effect articles.

Thus, for example, the same effect could be achieved by using instead of plastics material, glass, for the first and second preforms, or glass for one and plastics material for the other. However, glass would usually only be satisfactory in a planar form such as in a stained glass window. Otherwise the same technique could be used as has been described above with reference to the Figures. Similarly, instead of having a part spherical shape, the lamp shade or ornament structure could have any other suitable shape. For example, it could have an upper cylindrical portion, a frusto-conical main portion and a cylindrical skirt portion.

Furthermore, the second preform could itself be preformed in two or more sections that are arranged to interlock with one another to produce the completed second preform.

I claim:

1. A simulated stained glass article comprising as a united structure, in combination:

a. a first rigid preform of translucent material of a shape and size of the finished article having a smooth first surface;

b. a prepatterned colored film on the first surface of the first preform and in register therewith;

c. a second rigid preform of translucent material of a shape and size of said finished article having a smooth first surface located in contact with the film and a second surface with channels formed therein in register with the boundaries of said colored prepattern of the film, the second surface being remote from said film and said channels extending only part-way through the thickness of said second preform;

d. a material in said channels which has a lead-like appearance; and e. means sealing the free edges of the two preforms to one another.

2. A simulated stained glass article as claimed in claim 1, wherein the first preform is bowl shaped with its inner and outer surfaces smooth and wherein the second preform is of corresponding bowl-shape with its inner surface smooth and outer surface uneven.

3. A simulated stained glass article as claimed in claim 1, wherein said second preform comprises two preformed sections interlocked with one another to produce said second preform.

* * * * *